US006073379A

United States Patent [19]

Boyce

[11] Patent Number: 6,073,379

[45] Date of Patent: Jun. 13, 2000

[54] DISPLAY MAT

[76] Inventor: Daniel G. Boyce, 2304 169th Ave., NE., Ham Lake, Minn. 55304

[21] Appl. No.: 09/378,936

[22] Filed: Aug. 23, 1999

[51] Int. Cl.[7] ..... G09F 1/12

[52] U.S. Cl. ..... 40/735; 40/124.06

[58] Field of Search ..... 40/735, 773, 774, 40/775, 124.01, 124.06

[56] References Cited

U.S. PATENT DOCUMENTS 3,444,638 5/1969 Jahn ..... 40/735

5,044,100 9/1991 Roberts ..... 40/735

*Primary Examiner*—Cassandra H. Davis

[57] ABSTRACT

A display mat is provided with an oval and a rectangular opening in which the length and width dimensions of the rectangular opening, respectively, are substantially the same as the major and minor axes of the oval opening. A photographic print is provided and is detachably secured to the rear surface of the display panel for display of the photographic print through the rectangular or oval opening. A pair of verse panels having printing thereon are hingedly connected to the display panel such that the verse panels may be selectively displayed in the oval opening in a manner that the written material is arranged along the major axis or along the minor axis of the oval opening. The verse panels may be hingedly attached to the rear surface of the display panel such that the written material may be displayed in the rectangular opening along the length dimension or along the width dimension of the rectangular opening.

4 Claims, 1 Drawing Sheet

DISPLAY MAT

FIELD OF THE INVENTION

This invention relates to a display mat having an oval and a rectangular opening therein for selectively displaying a photographic print and written verse material in the openings.

BACKGROUND OF THE INVENTION

Commercial display mats are available which have rectangular openings and oval openings therein for displaying a verse and photographic print in the openings. Typically, the oval opening in these commercial display mats is smaller than the rectangular opening. Further, the photographic prints and verse panels are usually of different sizes in these commercial display mats. The photographic prints and reverse panels cannot be interchanged with respect to the oval and rectangular openings nor can the orientation of the print and verse panel be varied relative the display mat in these commercial display mats.

SUMMARY OF THE INVENTION

An object of this invention is to provide a novel display mat having oval and rectangular openings therein for displaying print and a verse panel, the photographic print and verse panel being readily interchangeable with respect to the oval and rectangular openings.

Another object of this invention is to provide a display mat in which a photographic print and a pair of verse panels are hinged to the display mat and may be selectively displayed in a rectangular or oval opening in the mat to thereby allow orientation of the print and of the lines of the verse to be selectively changed with respect to an opening.

DESCRIPTION OF THE PREFERRED EMBODIMENT

Figure 1:
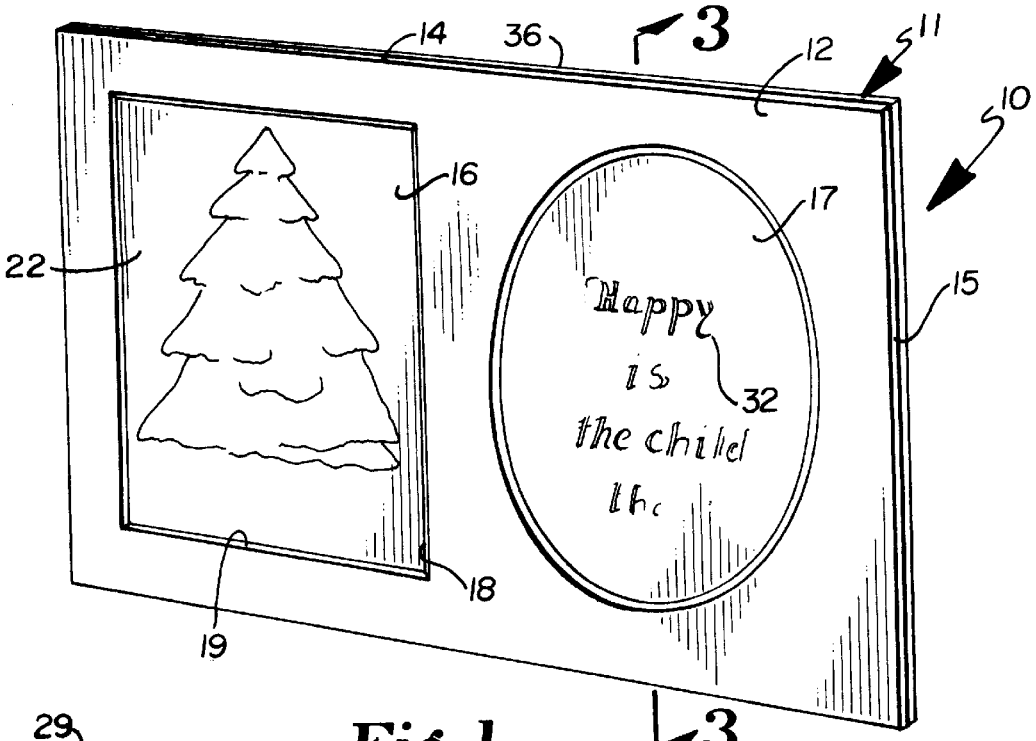
FIG. 1 is a front perspective view of the novel display mat.
Figure 2:
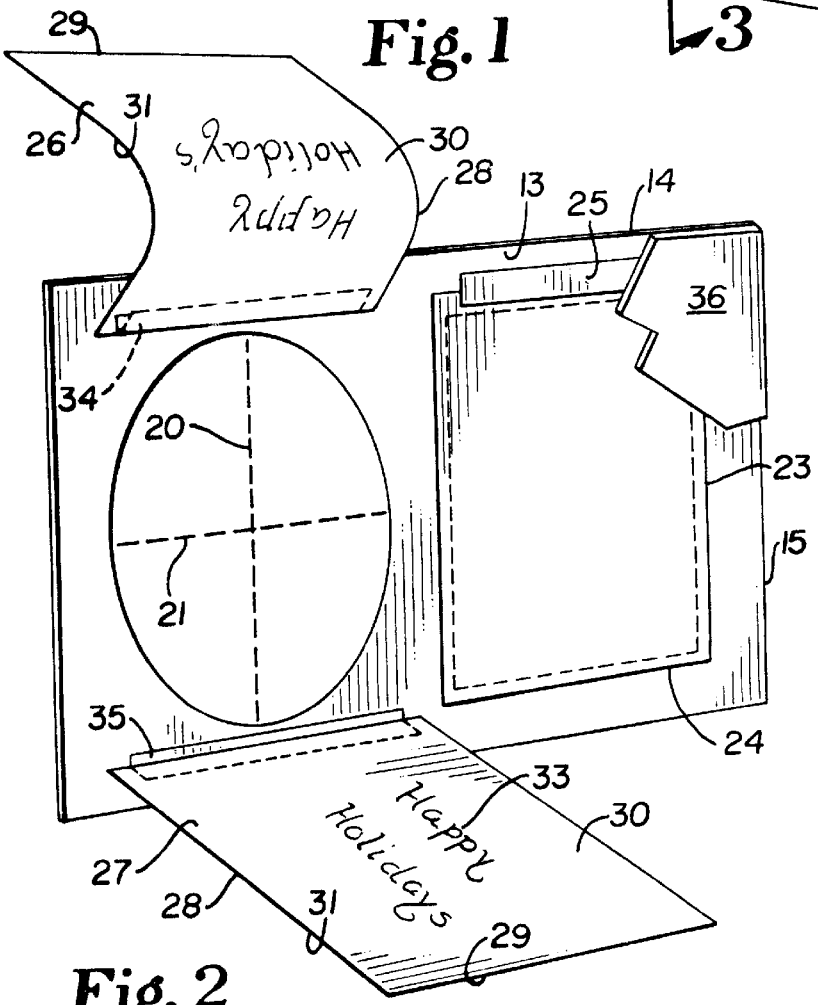
FIG. 2 is a rear perspective view of the display mat with the verse panels swung away from an opening in the mat.
Figure 3:
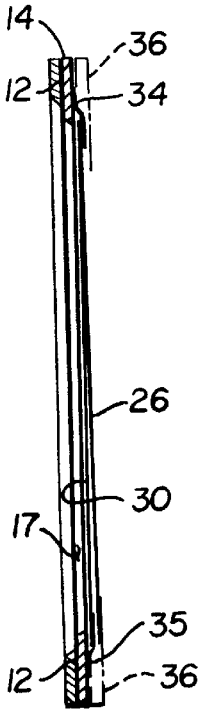
FIG. 3 is a cross-sectional view taken approximately along line 3—3 of FIG. 1 and looking in the direction of the arrows.

Referring now to the drawings, and more particularly to FIG. 1, it will be seen that one embodiment of the novel display mat, designated generally by the reference numeral 10, is thereshown. The display mat 10 is of rectangular configuration and is formed of a rigid cardboard or paperboard material. In the embodiment shown, a two ply (double mat panel) display panel 11 is provided, the two identical panels being secured together by a suitable glue or similar material. The display panel 11 has a front surface 12, rear surface 13, a longitudinal edge 14, and a transverse edge 15. A one ply panel may also be used.

The display panel 11 also has a rectangular opening 16 therein and an oval or elliptical opening 17 therein. It will be noted that the longitudinal and transverse edges, respectively define the length and width dimensions of the rectangular opening 16. The oval opening 17 has a major axis 20 and a minor axis 21. It is pointed out that the length of the longitudinal edge 18 is the same as the length of the major axis 20. Similarly the length of the transverse edge 19 of the rectangular opening 16 is the same as the length of the minor axis 21 of the oval opening.

The display mat 10 is also provided with a photographic print 22 which is of rectangular configuration. The longitudinal edge 23 and the transverse edge 24 of the photograph print are slightly greater than the length and width dimensions of the rectangular opening 16. The longitudinal and transverse edge of the photographic print are also slightly greater, respectively, than the major and minor axes of the oval opening 17. It is pointed out that the rectangular and oval openings are of a size to nicely accommodate the conventional 3 ½"×5" or 4"×6" photographic prints. The photographic print is secured to the rear surface 13 of the display panel by a flexible hinge strip 25. In the embodiment shown, the hinge strip 25 comprises a tape strip.

The display mat 10 is also provided with a pair of similar, flat, rectangular verse panels 26 and 27. It is pointed out that each of the panels 26 and 27 have longitudinal edges 28, transverse edges 29, a front surface 30, and a rear surface 31. Verse panel 26 has written information 32 on the front surface 30 thereof, while verse panel 27 has written information 33 on its front surface. This written information on each contains the same information and is in the form of a verse. However, the lines of verse (coherent lines) on verse panel 26 are arranged in the direction of the minor axis 21 of the oval opening 17 and in the direction of the transverse edge 29. Conversely, the lines of verse on the verse panel 27 extend in the direction of the major axis 20 of the oval opening 17 and in the direction of the longitudinal edges 28.

Verse panel 26 is secured to the rear surface 13 of the display panel 11 by a hinge strip 34 secured along a transverse edge portion of the panel in the manner of the photographic print 22. Similarly, the verse panel 27 is secured to the rear surface of the display panel 11 by a hinge strip 35. The hinge strips 34 & 35 are in the form of a suitable tape. It will be noted that the hinge strip 34 is located adjacent one longitudinal edge 14 of the display panel 11 while the hinge strip 35 is located adjacent the other longitudinal edge 14 of the display panel. With this arrangement the verse panels 26, 27 may be selectively positioned for display through the opening 17. A backing panel 36 is provided for retaining the print and verse panels in place. The backing panel 36 is identical in size and shape to the display panel 11.

It is pointed out that the verse panels 26 & 27 may be hinged to the rear surface of the display panel 11 for display through the rectangular opening 16. Similarly, the photographic print 22 may be hinged to the display panel 11 for display through the oval opening 17. In this regard, the photographic print may be oriented selectively along the major or minor axis of the oval opening 17 depending on the orientation of content of the print. While the display panel is provided with an oval and rectangular openings, it is pointed out that the panel may have two oval openings or two rectangular openings.

Given the respective sizes of the rectangular and oval openings, a wide range of positions of the photographic print and verse panels is possible with a minimum effort. This is not possible with commercially available display panels.

From the foregoing description, it will be seen that I have provided a novel and improved display panel for verse panels and photographic prints allowing a diversity of arrangements unavailable in prior art display panels.

What is claimed is:

1. A display mat for selectively displaying a photograph and a verse panel having written information on one surface thereof, comprising a rectangular display panel having a rectangular opening and a oval opening therein, the length dimension of the rectangular opening corresponding in size to the length of the major axis of the oval opening, the width dimension of the rectangular opening corresponding in size to the minor axis of the oval opening, said display panel having front and rear surfaces, a rectangular photographic print having a size greater than the area defined by either the rectangular opening or the oval opening, means hingedly detachably securing the photographic print to the rear surface of the display panel adjacent one of said rectangular or oval openings such that the photographic print may be displayed in one of said rectangular or oval openings, a pair of small verse panels each having the same written information on one surface thereof, means hingedly securing the small verse panels to the rear surface of the display panel adjacent the other of said rectangular or oval opening such that the written material on a selected one of said small verse panels may be displayed in the other of said rectangular or oval openings, the coherent written lines on said one small verse panel extending along the direction of the major axis of the oval opening, and the coherent written lines on the other verse panel extending along the direction of the minor axis of the oval opening when a selected one of said verse panels is positioned to display the coherent written material in said oval opening.

2. The display mat as defined in claim 1 wherein the photographic print may be selectively attached to rear surface of the display panel for displaying the photographic print for normal viewing along the length dimension of the rectangular opening, or for normal viewing along the width dimension of the rectangular opening depending on the arrangement of the content of the photographic print.

3. The display mat as defined in claim 2 wherein said photographic print may be attached to the rear surface of the display panel to selectively position the photographic print for display through the oval opening for normal viewing along the major axis of the oval opening, or for normal viewing of the photographic print along the minor axis of the oval opening depending on the arrangement of the content of the photographic print.

4. The display mat as defined in claim 3 wherein the verse panels may be hingedly secured to the rear surface of the display panel such that the written material on one of the verse panels may be displayed in said rectangular opening, the coherent written lines on said one panel extending along the direction of the length dimension of said rectangular opening, and the coherent written lines on the other verse panel extending along the width dimension of said rectangular opening when a selected one of said verse panels is positioned to display the written material through the rectangular opening.

* * * * *